US005211401A

United States Patent [19]

Hainey

[11] Patent Number: 5,211,401

[45] Date of Patent: May 18, 1993

[54] GOLFER'S PUTTER WITH WEIGHT RAISED TO CENTER OF BALL

[75] Inventor: Melvin F. Hainey, 10609 Pinehurst Dr., Austin, Tex. 78747

[73] Assignee: Melvin F. Hainey, Austin, Tex.

[21] Appl. No.: 913,155

[22] Filed: Jul. 14, 1992

[51] Int. Cl.[5] ..... A63B 53/04

[52] U.S. Cl. ..... 273/167 F; 273/167 R; 273/167 M; 273/169; 273/164.1

[58] Field of Search ..... 273/167 R, 167 A, 167 B, 273/167 F, 167 H, 169, 164.1

[56] References Cited

U.S. PATENT DOCUMENTS

| | | | |
|---|---|---|---|
| 3,085,804 | 4/1963 | Pieper | 273/167 B |
| 3,333,854 | 8/1967 | White | 273/167 B |
| 3,880,430 | 4/1975 | McCabe | 273/169 X |
| 4,314,701 | 2/1982 | Swanson | 273/167 X |
| 4,529,202 | 7/1985 | Sacobson | 273/174 X |
| 4,834,387 | 5/1989 | Waites et al. | 273/167 H X |
| 4,852,879 | 8/1989 | Collins | 273/164.1 |
| 4,881,739 | 11/1989 | Garcia | 273/164.1 |
| 4,921,253 | 5/1990 | Tesori | 273/167 F X |
| 5,100,146 | 3/1992 | Antonious | 273/169 X |

*Primary Examiner*—V. Millin
*Assistant Examiner*—Raleigh W. Chiu

[57] ABSTRACT

A putter head designed so that, during a normal stroke, the bulk of the weight of the head, not the center of weight, but the weight itself, will be concentrated about a horizontal plane through the center of the ball, thus yielding a very solid shot and one that feels solid. By using a thick upper plate and thin face and sole plates, this unique design feature is accomplished while retaining a conventional ball striking face and a solid sole plate, and at the same time providing a putter head that is pleasing to the eye and easy to align because of its clean straight lines.

1 Claim, 3 Drawing Sheets

GOLFER'S PUTTER WITH WEIGHT RAISED TO CENTER OF BALL

BACKGROUND

1. Field of Invention

This invention relates to golf clubs, specifically to a putter with improved weight distribution and attendant other advantages.

2. Description of Prior Art

From the grass around the fringe of a putting green many professionals in the game of golf will use a sand wedge, striking the middle of the ball with the bottom edge of the club. This is called "blading" the ball, and it has two advantages. First, it lessens the chance of the club getting hung up in the grass during the stroke because the club is raised up so that the bottom edge is at the level of the center of the ball. Second, it provides a very solid hit because much of the weight of a sand wedge is concentrated just back of the front edge that strikes the ball at the exact height of its center. This is a shot that requires considerable skill, and it is not one that could normally be used by the average golfer with much success. However, a putter head can be designed that will provide this same very solid feeling type of shot while requiring no more skill than would be required with any other kind of putter head.

Specifically, the club is designed so that most of the weight of the club, not the center of weight, but the weight itself, is concentrated, during the stroke, about a horizontal plane through the center of the ball. Light and thin metal forms the face and sole of the club, giving it a more or less conventional exterior configuration while having a minimal effect on the favorable weight distribution. In other words, this is a putter designed to "blade" the ball in a very controlled fashion, and it is quite different from prior club design art where almost every other conceivable weight distribution possibility has been proposed. This design does indeed provide a very solid feeling shot. The advantage is most noticeable on fast, closely mown, greens such as are found at major professional tournaments. Feel is extremely important in good shot making. Thus, in the very crowded field of putter design a significant improvement in the art is achieved.

In spite of the many patents in this field, an exhaustive search revealed nothing similar to the present invention. For example, U.S. Pat. No. 5,058,895 Igarashi (1991) discloses a putter with toe, heel, and back weighting disposed above its midline center of gravity; that is, above a horizontal plane through the center of the ball. However, it is the center of weight, not the weight itself, that is disposed above the midline. This is by no means the same improvement as that claimed for the present invention. Further explanation of this will be given in reference to the drawings herein. U.S. Pat. No. 4,999,000 Finney (1991) concerns a putter with high polar moment of inertia about a vertical axis, and this patent covers extensively the prior art in putter design, including the use of exotic metals to provide incremental improvements in weight and balance of a club head, yet it reveals nothing comparable to the present invention.

U.S. Pat. Nos. 4,979,744 Alcala (1990) and U.S. Pat. No. 4,915,385 Anderson (1990) both reveal putter head designs emphasizing the importance of weight and balance and eye appeal, yet neither will produce the solid feel and click of the present design which puts the bulk of the weight squarely behind the center of the ball. Further, when viewed from the putter's position over the ball they display many convoluted surfaces whereas the putter head of this invention is elegantly simple, displaying perfectly straight front and back faces to align perpendicular to the desired direction of ball flight, straight ends that align parallel to that direction, and a perfectly planar top surface with nothing to distract the eye.

Skelly in U.S. Pat. No. 4,199,144 (1980) discloses a putter head design with a rock hard plastic face which purportedly delivers a needed stronger force against the ball than that of a same-applied stroke of a conventional putter; however this putter has most of its weight at the sole of the club, not at the level of the center of the ball, and consequently, for the same stroke, it will not deliver as strong a force as the putter head of the present invention. Reuter in U.S. Pat. No. 3,652,093 (1972) describes a putter head design that puts the center of weight more directly behind the ball through the use of hollow toe and heel spaces, just the opposite of the more common toe and heel weighting. This design is supposedly better from just off the green, loft being designed into the club head. But here again, it is the center of weight that is behind the ball, the weight itself is not distributed around a horizontal plane through the belly of the ball, quite different from the present invention.

From the above, and from even the briefest survey of the art of putter head design, it is clear that what may appear to be very small improvements may be quite significant. Much is made of improved polar moment of inertia about a vertical axis achieved through the use of toe and heel weighting, and though the theory behind this idea sounds plausible, there is little real evidence that it will significantly improve a mis-hit putt. Be this as it may, the Ping series of putters which feature this type of weighting have been an outstanding commercial success, probably outselling any other putter ever made. Putting is such a psychological thing, that if the golfer thinks that one putter is better than another, he will undoubtably use it better. The putter design of the present invention has a real advantage over other putters, but perhaps just as important, it is an advantage that will be quite understandable to almost all experienced golfers, inspiring confidence in their ability to use the putter and thus making it more effective still. Further advantages related to the producibility of the putter will be discussed later.

OBJECTS AND ADVANTAGES

The objects and advantages of the present invention are:

(a) to provide a golfer's putter with improved weight distribution such that, during a normal stroke, the bulk of the weight of the head lies close to a horizontal plane through the center of the ball, thus yielding a hit that is very solid, and one that feels solid to the golfer.

(b) to provide a relatively thin face plate and sole plate for the above putter configuration so that there is a minimal effect on the favorable weight distribution while forming a putter that can be used the same as any other putter to deliver its unusually solid stroke.

(c) to provide a putter that when viewed from above as in a normal stroke can have a variety of shapes, rectangular, semi-circular, u-shaped, or whatever, as long as these shapes have approximately the same area, while at the same time maintaining the favorable weight distribution described above.

(d) to provide a putter with a connection between the head and shaft, called a hosel, which can be straight or bent into any of a number of configurations, all of which are compatible with the unique weight distribution of the club.

(e) to provide a putter with a perfectly vertical, or straight, face or one with various degrees of loft; that is, a face with various degrees of tilt away from the ball when the club is in the normal position for a shot, each of which would have a minimal effect on the weight distribution of the club.

(f) to provide a putter which is hollow but which may be filled with lightweight material such as balsa wood or plastic foam without significantly affecting the overall weight and balance of the club.

(g) to provide a putter that is easy to manufacture, one that could if desired be made entirely of standard stock material without any compromise of basic design features, so that a limited production run for sales testing could be made for minimal cost.

Other objects and advantages of this invention will become apparent from consideration of the detailed description which follows.

DRAWING FIGURES

DESCRIPTION—FIGS 1TO 9

Figure 1:
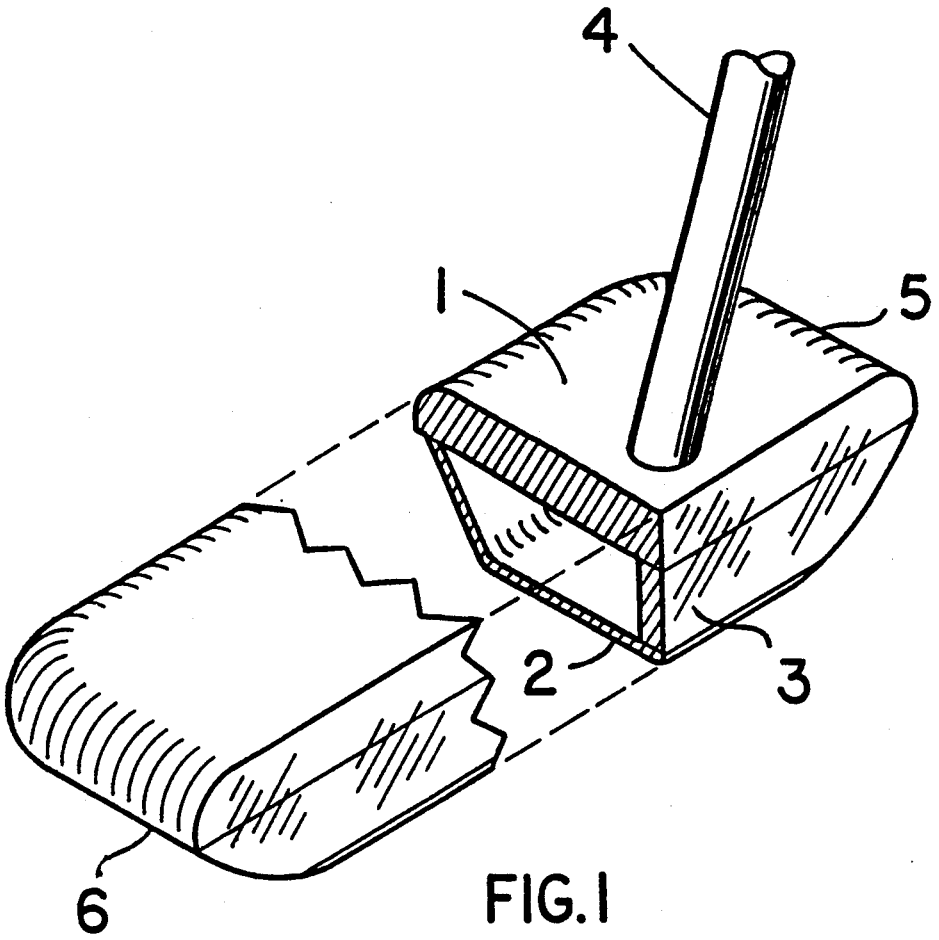
FIG. 1 is a sectionalized pictorial view of the putter head showing clearly the unique weight distribution.

The sectionalized pictorial of FIG. 1 shows clearly the means for arranging the bulk of the putter head weight directly behind the center of the ball in one embodiment of the invention. The center of the thick top plate 1 is just high enough above the thin bottom or sole plate 2 so that during a normal stroke it will lie in a horizontal plane through the center, or belly, of the ball. This spacing is achieved by using a thin piece of metal 3 to form the face of the club while the back of the thin sole plate 2 is bent upward to form the back of the club, these three pieces being solidly brazed or otherwise fastened together. The shaft 4 can be inserted anywhere in the top plate, but usually it is best placed near the front face 3 and more toward the heel 5 than the toe 6 of the club head. The shaft 4 of the club can be straight, as shown here, so that the axis of the shaft falls slightly behind the front face or it can be bent into any number of configurations, a common one being such that the axis of the shaft falls slightly in front of the front face of the club.

Figure 2:
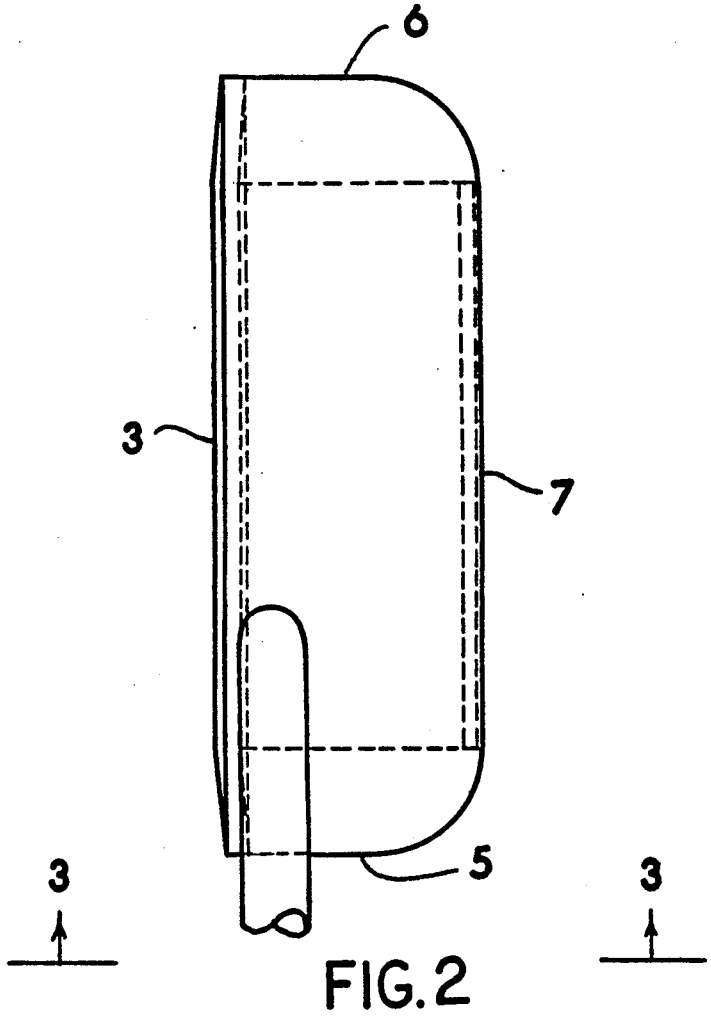
FIG. 2 is a view of the putter head as it would be seen by the golfer when ready to make a stroke.

FIG. 2 shows the exceptionally clean lines of this same embodiment of the club in a golfer's-eye-view of the club as it would appear in position for a normal stroke. The front face 3 and the back 7 of the club line up exactly perpendicular to the desired direction of ball flight whereas the toe 6 and heel 5 ends line up exactly parallel to this direction. Although the top surface of the club is perfectly plain in this embodiment a line perpendicular to the front face and half way between the toe 6 and heel 5 could easily be inscribed to indicate the center of precussion or the so-called sweet spot of the club. This line would then be lined up with the center of the ball prior to the stroke so that the ball would not be struck off center and it would serve as a further directional alignment aid. The plain top surface of the club would allow many other alignment markings if desired, and, in fact, it would be a simple matter for each individual golfer, if they like markings, to inscribe their favorite on this planar surface.

Figure 3:
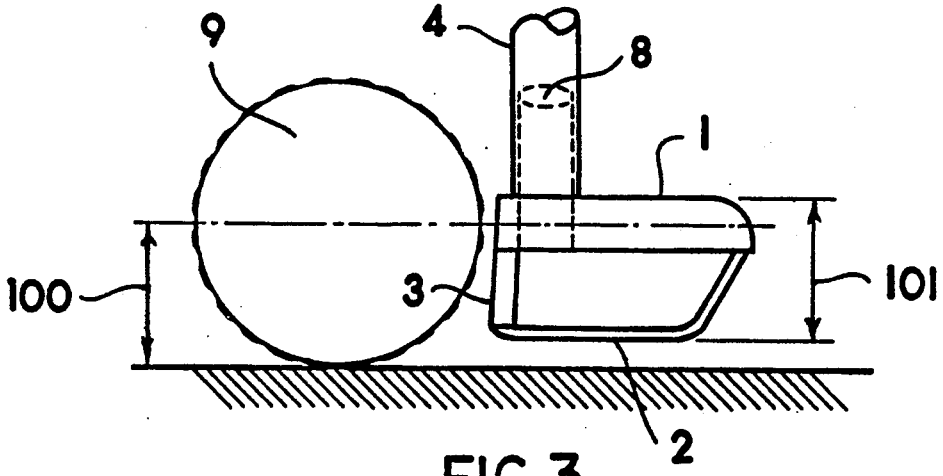
FIG. 3 is a ground level, end view of the putter.

FIG. 3 is a ground-level end view of the putter head as it would appear just before impact with the ball. Note that the dimensions 100 and 101 are the same, that is, 0.84 inches which is the radius of the standard golf ball. Thus the ball cannot be struck below its center for the club head would hit the ground first. If it is struck slightly higher or lower than shown here the shot will not be adversely affected. It turns out that if the ball is struck with the same stroke that would be used with any putter, it is perfectly natural and easy to strike the ball with the putter head of this invention in just about exactly the position shown in FIG. 3. There is, however, a distinctly solid feel to the shot with this putter head which is highly desirable. It may be noted in FIG. 3, also, that there is a slight bit of loft in the club face 3; that is, the face is slightly tilted away from the ball so that a slight upward momentum is given to the ball on impact. Some believe that this tends to make the ball take off a little smoother on impact. About three degrees of loft is common for putters. The point here is that any normal degree of loft is perfectly compatible with the head design of this invention. FIG. 3 also shows with dotted lines how the putter shaft fits around the small straight hosel 8 of this embodiment. It is usually this hosel that is bent to form different shaft-to-head arrangements.

Figure 4:
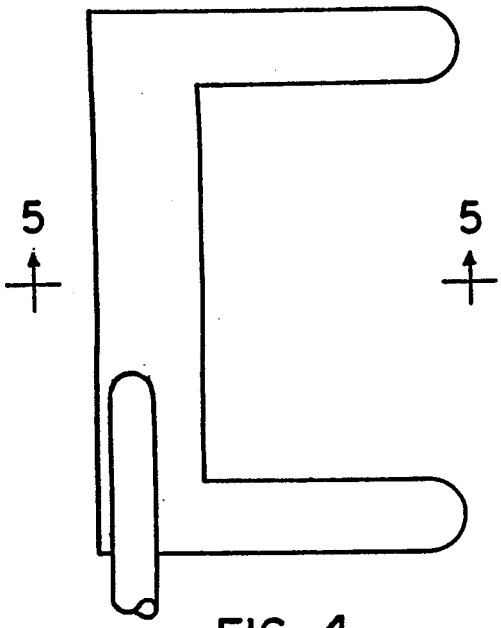
FIG. 4 is a golfer's-eye-view of an alternate, u-shaped head design.
Figure 6:
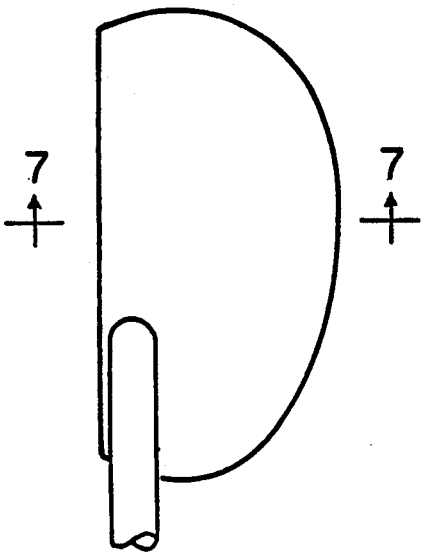
FIG. 6 is a golfer's-eye-view of a somewhat semi-circular head design called a mallet head shape.
Figure 5:
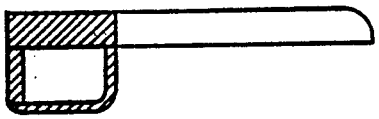
FIG. 5 is a sectional view of the u-shaped head design.
Figure 7:
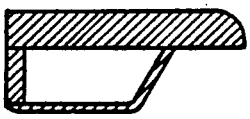
FIG. 7 is a sectional view of the mallet head design.

FIGS. 4 and 6 are golfer's-eye-views of two alternate embodiments of the present invention. Although they appear drastically different from the previously described embodiment, the sectional views of FIGS. 5 and 7 show that they involve the same unique principle of weight concentration about the horizontal plane through the center of the ball, and they will provide the same solid feeling shot. These figures show the wide variation possible in head design while retaining the central features of this invention. The u-shaped configuration of FIG. 4 would probably be more suitable for one of the longer shafted putter, around 40 inches, now popular on the senior golfer's professional tour. The mallet head design of FIG. 6 has long been popular with many golfers. Although a putter head similar to that of FIG. 1, with perhaps slight variations in the length from heel 5 to toe 6 and the width from the face 3 to the back 7, is the preferred embodiment of this invention, many other shapes, as long as they have approximately the same top surface area and thickness can provide the same advantages.

Figure 8:
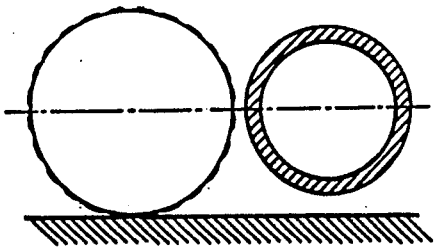
FIGS. 8 and 9 are sectional views similar to those of FIGS. 5 and 7 above of hypothetical head designs which have their centers of weight at the level of the center of the ball, but not the weight itself.
Figure 9:
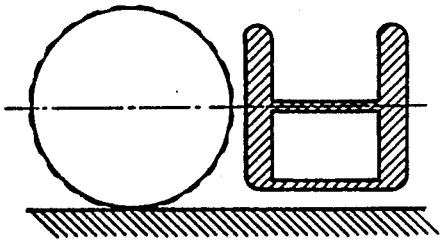

FIGS. 8 and 9 are views of hypothetical putter heads in sectional views similar to those of FIGS. 5 and 7, and they are included here to illustrate graphically the difference between having the actual mass of the club head behind the center of the ball at impact, as in the latter, and having the center of mass behind the ball at impact, as in the former. It is clear from these figures that the hypothetical club heads would not deliver the same solid feeling shot.

SUMMARY, RAMIFICATIONS, AND SCOPE

A golfing putter is described which is configured so that during a normal stroke the bulk of the weight of the putter will be directly behind the center of the ball yielding a very solid shot, yet the external configuration of the putter has the same features as most other putters, a toe and heel, front face and back, and a sole plate. This is achieved by using a thick upper plate for the bulk of the putter with a thin face plate and a thinner still sole plate which is curved upward to join the upper plate at the back of the putter. A sole plate is needed when addressing the ball prior to a shot so that the putter may be put down directly behind the ball during the alignment process then raised just slightly to make the stroke. The sole plate is also needed to tamp down divot repairs and to tamp down spike marks after completion of the hole.

Although a preferred embodiment of this invention is discussed above, it is pointed out that many other configurations are possible which incorporate its essential features. For example, the putter could be made of a variety of materials, steel, brass, various alloys, or some of the newer composite materials such as Kevlar or fibers of carbon or boron. Further, any number of alignment markings, hosel arrangements, degrees of loft can be incorporated while maintaining the essential weight distribution.

Thus the scope of this invention should be determined by the appended claims, not the specific examples given.

I claim:

1. In a golfing putterhead for striking a golf ball defining a ball striking front face, a bottom surface, a top surface, a rear surface, a heel and a toe, and a hosel for connecting the putter head to a shaft, (a) said top surface comprised of an upper surface element joined to the hosel, said upper surface element having a weighted means for substantially concentrating the weight of the putter head along a horizontal plane, wherein said horizontal plane bisects said upper surface element and coincides with a horizontal plane through the center of a golf ball when the putter head strikes the golf ball, (b) said ball striking front face comprised of a thin, elongate, light-weight face plate and joined to said upper surface element, and, (c) said bottom surface comprised of a thin sole plate substantially parallel to said upper surface element and joined to said ball striking front face, said sole plate having an upwardly bent rear end joined to said upper surface element.

* * * * *